United States Patent [19]

Fortenberry

[11] Patent Number: 4,599,919

[45] Date of Patent: Jul. 15, 1986

[54] SHARPENING DEVICE

[76] Inventor: Roland D. Fortenberry, 16144 Forest Bend Ave., Friendswood, Tex. 77546

[21] Appl. No.: 583,710

[22] Filed: Feb. 27, 1984

[51] Int. Cl.[4] ..... B21K 11/00

[52] U.S. Cl. ..... 76/86

[58] Field of Search ..... 76/86, 82, 82.2; 51/205 WG, 285

[56] References Cited

U.S. PATENT DOCUMENTS

| | | | |
|---|---|---|---|
| 950,530 | 3/1910 | Dow | 76/86 |
| 1,041,631 | 10/1912 | Johnson | 76/86 |
| 1,111,273 | 9/1914 | Rybarsky | 76/86 |
| 2,951,400 | 9/1960 | Renne, Jr. et al. | 76/86 |
| 4,418,588 | 12/1983 | Byers | 76/82.2 |

FOREIGN PATENT DOCUMENTS

| | | | |
|---|---|---|---|
| 104205 | 7/1899 | Fed. Rep. of Germany | 76/86 |
| Ad.6915 | of 1905 | United Kingdom | 76/86 |
| 652581 | 4/1951 | United Kingdom | 76/86 |

*Primary Examiner*—Roscoe V. Parker

*Attorney, Agent, or Firm*—Robert W. B. Dickerson

[57] ABSTRACT

A device to sharpen a blade, comprising a hand-grip, a dual, beveled-edge, reversible, blade cutting or honing system, and a finger protector displaceably carried by said hand-grip.

7 Claims, 13 Drawing Figures fig. 4-A fig. 1-A fig. 5-A fig. 2-B fig. 2-A

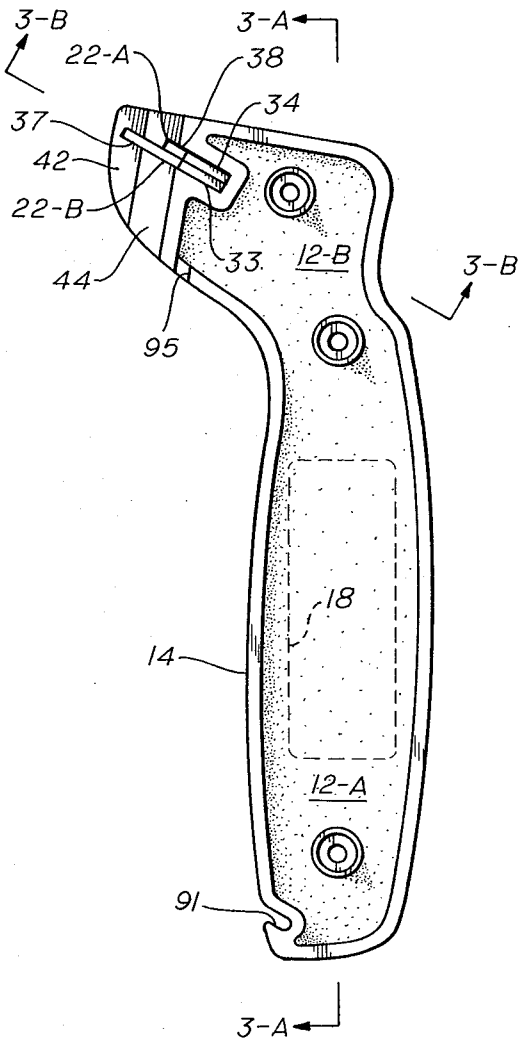
fig. 3
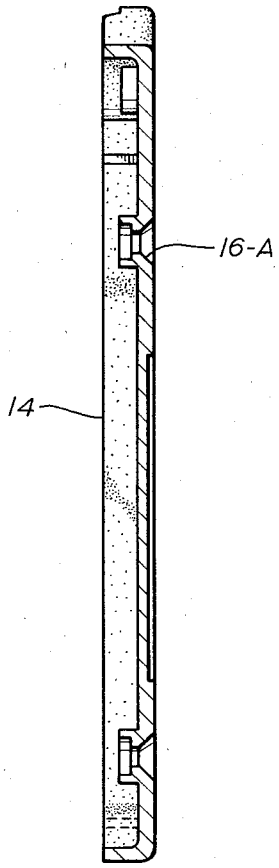
fig. 3-A
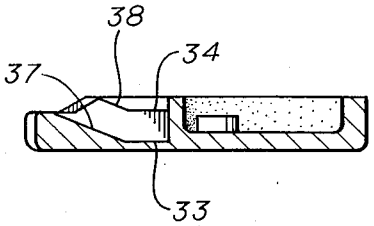
fig. 3-B

SHARPENING DEVICE

BACKGROUND OF THE INVENTION

From the dawn of civilization, man has made and improved on his tools. Ancient peoples have been compared based on their ability to fabricate such devices as arrows, knives, chisels and other cutting instruments. After fabrication the tool must be periodically re-sharpened or replaced. Sharpening instruments have taken many forms. In modern society, hunters, fishermen, craftsmen and tradesmen, and home handymen universally have several instrumentalities used for cutting that must be kept sharp in order to retain their usefulness. It was to assist in achieving this goal, in an efficient manner, that Applicant developed his invention.

SUMMARY OF THE INVENTION

A hollow handle is comprised of separate halves, releasably joined together. Each half carries a cutting blade. Each blade includes a pair of cutting surfaces, and may be interchangeably positioned in either section. A finger protector may be affixed to the assembled handle.

DESCRIPTION OF THE DRAWINGS

FIG. 1-A is a top plan of the assembled device;

FIGS. 2 and 3 are side elevations of the two handle halves;

FIGS. 2-A and 3-A are sections taken along lines 2A—2A and 3A—3A of FIGS. 2 and 3, respectively;

FIGS. 2-B and 3-B are sections taken along lines 2B—2B and 3B—3B of FIGS. 2 and 3 respectively;

FIG. 4-A is an elevation, looking in the direction of section 4—4 of FIG. 4;

FIG. 6 is a front elevation of a typical knife, with which this device may be used.

DESCRIPTION OF A PREFERRED EMBODIMENT

Figures 2, 6:
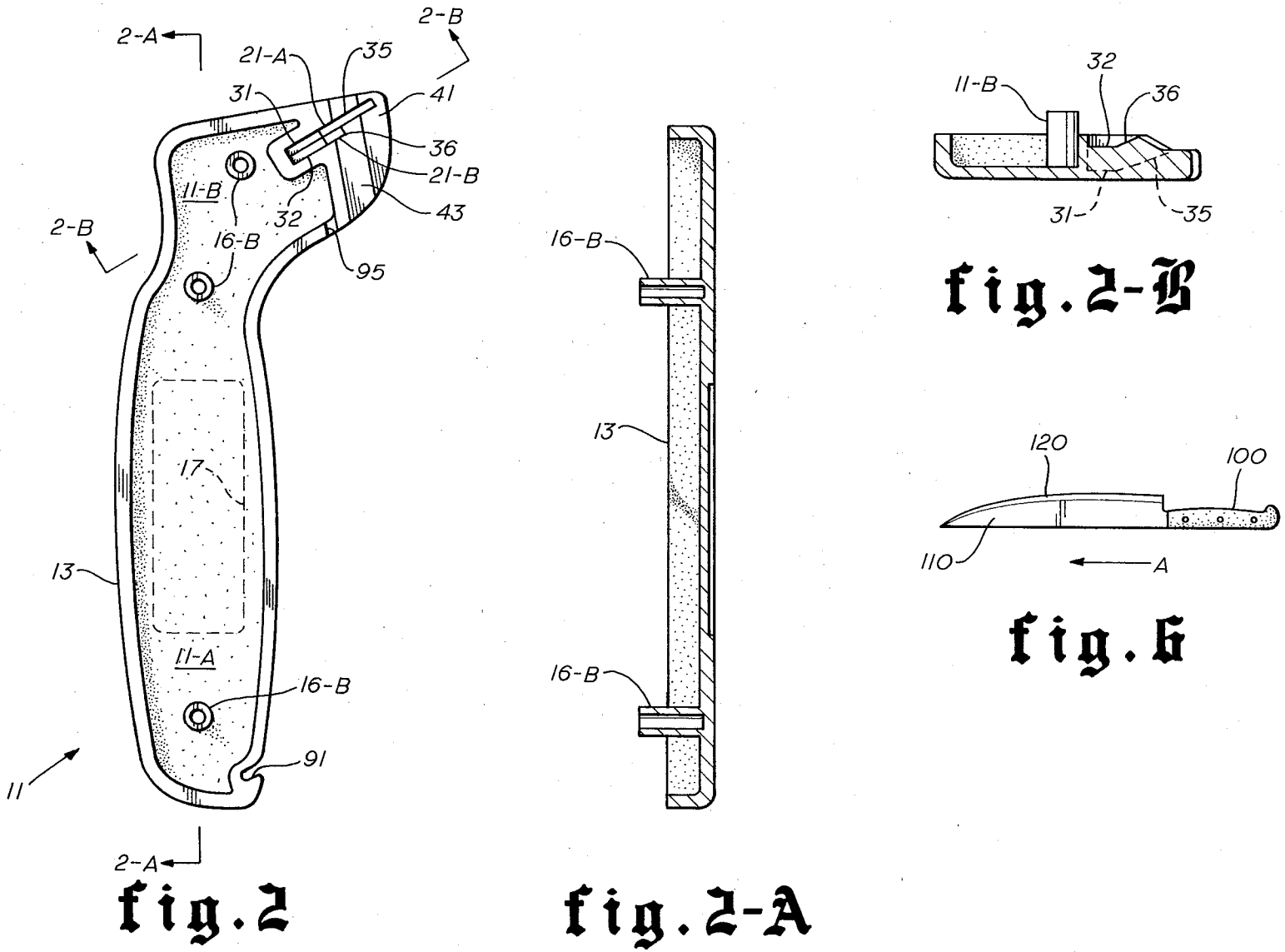

The knife of FIG. 6 includes a handle 100 and depending blade 110. The blade 110 includes a cutting edge 120. The sharpening device of this invention would advantageously be used by resting the knife on its edge opposite cutting surface 120, so as to permit the sharpener to have its blades engage edge 120 and move therealong in the direction of Arrow "A".

Look now at the invention shown in FIGS. 1–5. The sharpening device is generally illustrated by the numeral 20, and has two separate sides 11 and 12. Each such side is generally hollow and includes a peripheral wall or skirt, 13 and 14 respectively, substantially therearound. Each side further includes a handgrip portion, 11-A or 12-A, and a depending head portion 11-B or 12-B, for cutting blade positioning. To this point it is easily determined that each side is substantially a mirror image of the other. They are held together by flat headed, fasteners 16, whose head comes to rest in one of three beveled bores 16-A, provided side 12, and whose threaded shanks each matingly engage one of three female wells 16-B, provided side 11. Each of handgrip portions 11-A, 12-A, may be provided on its laterally extending outer surface, as at 17 or 18, respectively, with a rectangular, recess, to accommodate an identification or indicia bearing plate.

The head portions 11-B, 12-B of each side includes a pair of laterally extending, side-by-side, depressions or cut-outs, these being numbered 21-A, 21-B on side 11, and 22-A, 22-B on side 12. Each such cut includes a base, 31 and 32 for side 11 and 33, 34 for side 12, approximately parallel to the handgrip portions areas 17 or 18, and an angularly related portion (35, 36 for side 11 and 37, 38 for side 12), all for accommodating the blades or cutting members hereinafter described. One end of the head portion of each side is recessed, each such recess including a flattened surface 41, 42, and an inclined connecting surface 43, 44.

Figure 4:
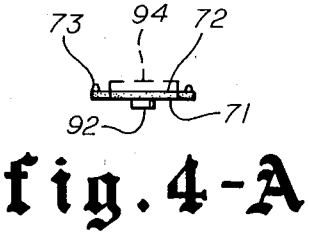
FIG. 4 is a plan view of the finger strap.
Figure 4:
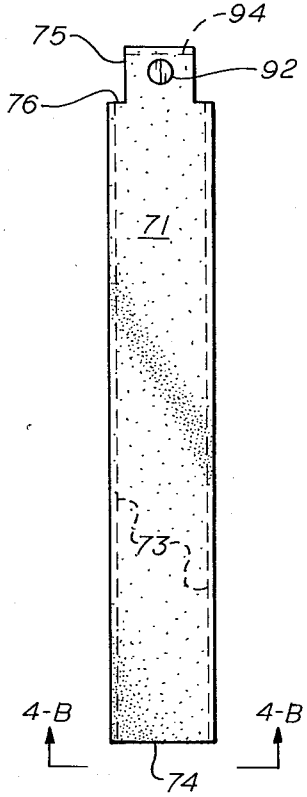
Figure 5:
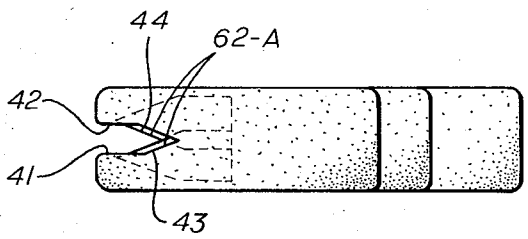
FIGS. 5 and 5-A are front and side elevations, respectively, of a cutting blade.
Figure 5:
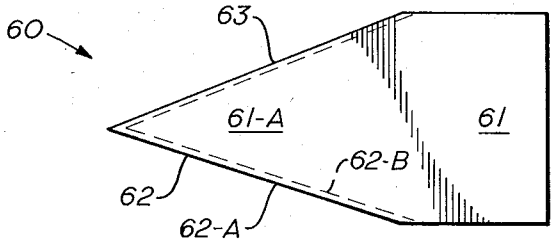

The cutting members 60 are alike, and each has the general configuration of an arrowhead, see FIGS. 5 and 5-A. Both front and back sides have a generally rectangular base portion 61 and head portion 61-A. Sides 62 and 63 are beveled, to form leading and trailing edges 62-A, 62-B, for each such side. If a section is taken through head 61-A then the lateral separation between leading edges 62-A is greater than that of trailing edges 62-B.

Figure 1:
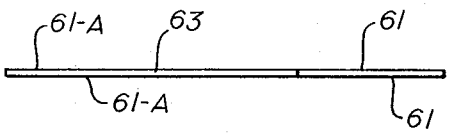
FIG. 1 is a perspective of the assembled device.
Figure 1:
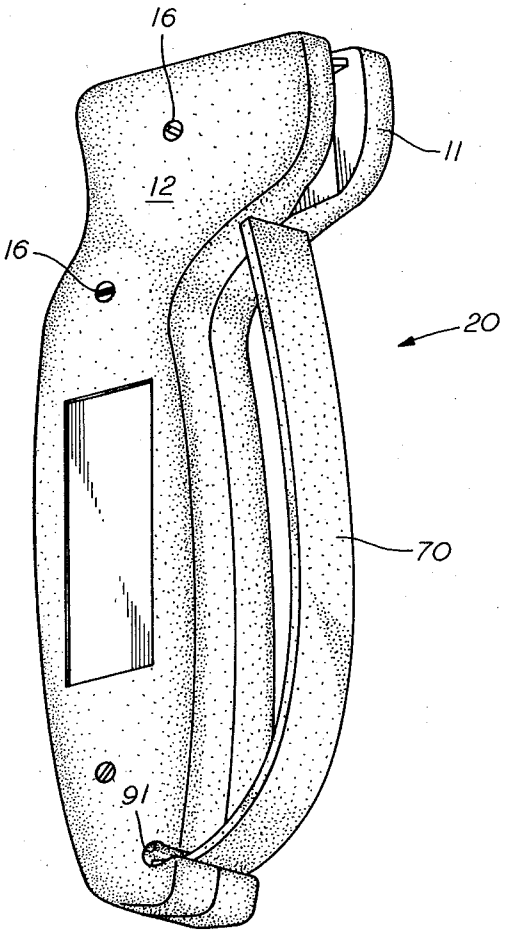

Finger protector 70 includes a strap portion being flat on one side 71 and having spaced beads 73 along the lateral edges of the opposite side 72. Trailing edge 74 of the strap is adapted to be removably inserted within recess 91, which recess is formed, in an aligned manner, across both handgrip portions 11-A, 12-A. A tab 75 depends from the other edge 76 of the strap. This finger protector may be attached to the assembled and united sides 11, 12 by means of nipple 92 in tab 75, or by ridge 94 (see phantom lines depending from one edge of tab 75) being inserted through counterpart apertures 95 formed in the skirt of each side 11 and 12. Such insertion would occur just prior to joining said sides by means of fasteners 16. Also just prior to such joining, a blade would be inserted within each side, in the cut-out of greatest length. Inside 11, for example, one side edge of the rectangular blade section 61 would rest astride base section 31 of cut-out 21-A with either cutting section 62, 63 along angled portion 35, such that leading edge 62-A would be exposed, as seen in FIG. 1-A. The counterpart blade, similarly positioned within side 12, such that within side 11, said counterpart blade, would have one of its section 61 side edges rest astride base section 32 with its cutting section along angled portion 36, again with its cutting edge 62-A being exposed in the top view of FIG. 1-A.

One of the key features of this invention concerns the added blade life. This occurs because each blade has dual cutting edges, 62-A. Each blade may be interchangeably positioned in cuts 21-A of side 11 or 22-B of side 12. Any such exchange would reverse the cutting edge 62-A being used. Recall, however, that the cutting edge must always be the leading edge 62-A, not the trailing edge 62-B.

Although only a single general embodiment has been described, it should be obvious that numerous modifications would be possible by one skilled in the art without departing from the spirit of the invention, the scope of which is limited only by the following claims.

I claim:

1. A sharpening device comprising:

sharpener holder means comprising a pair of opposed, releasably joinable, side portions, each said side portion having a laterally extending outer surface, said holder means having a pair of sharpener members carried thereby, said sharpener members each having opposed beveled sides forming a cutting and a trailing edge on each said side, said sharpener members being positioned perpendicular to said holder means' said outer surfaces and so oriented relative to said holder means that each said cutting edge leads its respective said trailing edge relative to a device to be sharpened, and means carried by each of said side portions for reversing the orientation of said sharpener members.

2. The device of claim 1 wherein said reversing means includes slot means carried by each of said side portions of said holder means, each said slot means including seat means for each of said sharpener members.

3. The device of claim 1 and including user protector means comprising a barrier member releasably engageable at each end thereof with said holder means.

4. In a device for sharpening objects, the combination of:

housing means comprising a pair of housing halves releasably joined together, each such half including a gripping portion, a cutter holding portion, a laterally extending outer face with a peripheral wall extending perpendicularly there around, and cutter seat means;

cutter means interchangeably positionable in each said seat means, each said cutter means having a pair of intersecting beveled edges forming a pair of cutting edges, each said cutting means being positionable perpendicularly with respect to said outer face.

5. The combination of claims 4 wherein each said cutter seat means includes slot means to receive at least part of both of said cutter means.

6. The combination of claim 5 wherein each said slot means includes a pair of adjacent slots, one of said slots in each said slot means being of a greater dimension than the other slot.

7. The combination of claim 4 and including user protecting means adapted to circumscribe, along with said housing means, a user's fingers, said protecting means being releasably engageable, at each end thereof, with said housing means.

* * * * *